US009449486B2

(12) United States Patent
Hong

(10) Patent No.: US 9,449,486 B2
(45) Date of Patent: Sep. 20, 2016

(54) SOLITARY SENIOR PEOPLE CARE SYSTEM

(71) Applicant: LSIS CO., LTD., Anyang-si, Gyeonggi-do (KR)

(72) Inventor: Gwon Hwan Hong, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 214 days.

(21) Appl. No.: 14/258,858

(22) Filed: Apr. 22, 2014

(65) Prior Publication Data

US 2014/0333437 A1 Nov. 13, 2014

(30) Foreign Application Priority Data

May 13, 2013 (KR) ..... 10-2013-0053844

(51) Int. Cl.
*G08B 23/00* (2006.01)
*G08B 21/04* (2006.01)

(52) U.S. Cl.
CPC ..... *G08B 21/0484* (2013.01)

(58) Field of Classification Search
CPC ..... G08B 21/0484; G08B 21/22; G08B 21/0288; G08B 21/0446; A61B 5/0002; G06F 19/3418
USPC ..... 340/573.1
See application file for complete search history.

(56) References Cited

U.S. PATENT DOCUMENTS

2012/0086573 A1* 4/2012 Bischoff ..... G06F 19/3418 340/573.1
2014/0172758 A1* 6/2014 Klinnert ..... G08B 21/0423 706/12

FOREIGN PATENT DOCUMENTS

| | | |
|---|---|---|
| JP | 2003-152902 | 5/2003 |
| JP | 2003-178378 | 6/2003 |
| JP | 2008-211450 | 9/2008 |
| JP | 2010-186397 | 8/2010 |
| JP | 2012-068774 | 4/2012 |
| JP | 2012-128472 | 7/2012 |

OTHER PUBLICATIONS

Japan Patent Office Application Serial No. 2014-099310, Office Action dated Sep. 15, 2015, 4 pages.
Japan Patent Office Application Serial No. 2014-099310, Office Action dated Mar. 26, 2015, 4 pages.

* cited by examiner

*Primary Examiner* — Kerri McNally
(74) *Attorney, Agent, or Firm* — Lee, Hong, Degerman, Kang & Waimey; Jonathan Kang; Richard Salfelder

(57) ABSTRACT

A solitary senior people care system comprises: an electric device switch installed within a household where a senior resident resides; a household monitoring communication device configured to provide the on or off state information and identity information of the electric device switch together; an electric device switch history server computer that stores and provides solitary senior resident household electric device switch usage history information, electric device switch setting information, and electric device switching state information; and a care device configured to notify an emergency rescue center or a guardian contact number about occurrence of an emergency situation when an emergency situation occurs, the solitary senior resident household electric device switch usage history information, and the state value information indicating whether an emergency situation has occurred.

16 Claims, 5 Drawing Sheets

SOLITARY SENIOR PEOPLE CARE SYSTEM

CROSS-REFERENCE TO RELATED APPLICATION

Pursuant to 35 U.S.C. §119(a), this application claims the benefit of earlier filing date and right of priority to Korean Application No. 10-2013-0053844, filed on May 13, 2013, the contents of which is incorporated by reference herein in its entirety.

BACKGROUND OF THE INVENTION

1. Field of the Invention

The present disclosure relates to a solitary senior people care system, and particularly, to a solitary senior people care system allowing solitary senior people, who is not able to request for rescue, to determine his or her physical abnormality based on an abnormal sign and inform a management authority accordingly by using a smart meter and power line communication technology.

2. Background of the Invention

A solitary senior people care system refers to a system capable of preventing and monitoring an accident due to generation of a sudden physical problem of a solitary senior resident in preparation for an increase in solitary senior people according to population aging.

As a related art of a solitary senior people care system, Patent document below may be referred to.

(Patent Document 1) Korean Patent Registration No. 10-1197572 (Entitled: "PLC-based VoIP Interphone System for Solitary Senior People")

However, the system disclosed in Patent Document No. 10-1197572 is able to rescue a solitary senior resident only when the corresponding solitary senior resident provides his or her situation through data communication or voice communication through an interphone, and cannot cope with a situation in which a solitary senior resident encounters a sudden physical problem such that he or she lapses into unconsciousness so he or she cannot deliver his or her situation by himself or herself

SUMMARY OF THE INVENTION

Therefore, an aspect of the detailed description is to provide a solitary senior resident care system allowing solitary senior people, who is not able to request for rescue, to determine his or her physical abnormality based on an abnormal sign and inform a management authority accordingly.

To achieve these and other advantages and in accordance with the purpose of this disclosure, as embodied and broadly described herein, a solitary senior people care system comprising:

an electric device switch installed within a household where a solitary senior resident resides;

a household monitoring communication device having a communication unit, connected to the electric device switch through a power line, configured to monitor on or off state information of the electric device switch, and configured to provide the on or off state information and identity information of the electric device switch together;

an electric device switch history server computer connected to the household monitoring communication device through a communication network, and that stores and provides a solitary senior resident household electric device switch usage history information including information regarding a date and time at which the electric device switch was finally in an on state and information regarding a date and time at which the electric device switch was finally in an off state, electric device switch setting information including reference information for determining occurrence of an emergency situation, and electric device switching state information including at least any one of electric device switch on or off state information of a solitary senior resident house, identity information of the electric device switch, identity information of the solitary senior resident household, and state value information indicating whether an emergency situation has occurred determined based on information regarding a time lapsed after an final operation of the electric device switch and the electric device switch setting information; and a care device connected to the electric device switch history server computer, and configured to notify an emergency rescue center or a guardian contact number about occurrence of an emergency situation when an emergency situation occurs according to at least any one of the electric device switch state information, the solitary senior resident household electric device switch usage history information, and the state value information indicating whether an emergency situation has occurred, from the electric device switch history server computer.

According to an aspect of the present disclosure, the electric device switch is configured as a capacitive sensing type touch switch or an ordinary contact type electric light switch.

According to another aspect of the present disclosure, the solitary senior people care system may further comprises an emergency rescue request switch installed in a household where a solitary senior resident resides, and connected to the household monitoring communication device to transmit an emergency rescue request signal to the electric device switch history server computer through the household monitoring communication device.

According to another aspect of the present disclosure, the reference information includes any one of the electric device switch on or off elapse reference time information, daytime or nighttime state discrimination setting and cancelling information, and emergency situation occurrence setting or cancelling information.

According to another aspect of the present disclosure, the electric device switch state information may further comprise at least one of information regarding an elapse time after a final on or off operation of the electric device switch, an absence mode state value indicating whether a senior resident of a corresponding household is absent, information regarding a guardian contact number in the occurrence of an emergency situation, and emergency rescue center contact number information in the occurrence of an emergency situation.

According to another aspect of the present disclosure, the solitary senior resident household electric device switch usage history information may further comprises at least one of information regarding an average operation time from a point in time at which the electric device switch is turned to a point in time at which the electric device is tuned off, solitary senior resident emergency situation occurrence date and time information, and absence mode setting date and time information.

According to another aspect of the present disclosure, the household monitoring communication device may be configured as a smart meter or a home control unit.

According to another aspect of the present disclosure, the solitary senior people care system may further comprises an automatic response system (abbreviated as ARS hereinafter) connected to the electric device switch history server computer, and configured to, when the electric device switch history server computer determines that an emergency situation has occurred, automatically making a call to a previously stored phone number to check state value information indicating whether the emergency situation has occurred or provide information for cancelling the setting of emergency situation occurrence to the electric device switch history server computer.

To achieve these and other advantages and in accordance with the purpose of this disclosure, as embodied and broadly described herein, a household monitoring communication device comprising:

a communication unit installed in a household of a solitary senior resident, connected to an electric device switch installed in the household through a power line, and transmit at least any one of the electric device on or off time information, the previously stored electric device identity information, previously stored user identity information, and emergency situation determining reference information.

According to an aspect of the present disclosure, the emergency situation reference information comprises any one of the electric device switch on or off elapse time reference information, a daytime or nighttime discrimination setting or cancelling information, and emergency situation occurrence setting or cancelling information.

According to another aspect of the present disclosure, the household monitoring communication device is configured as a smart meter or a home control unit.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this disclosure, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
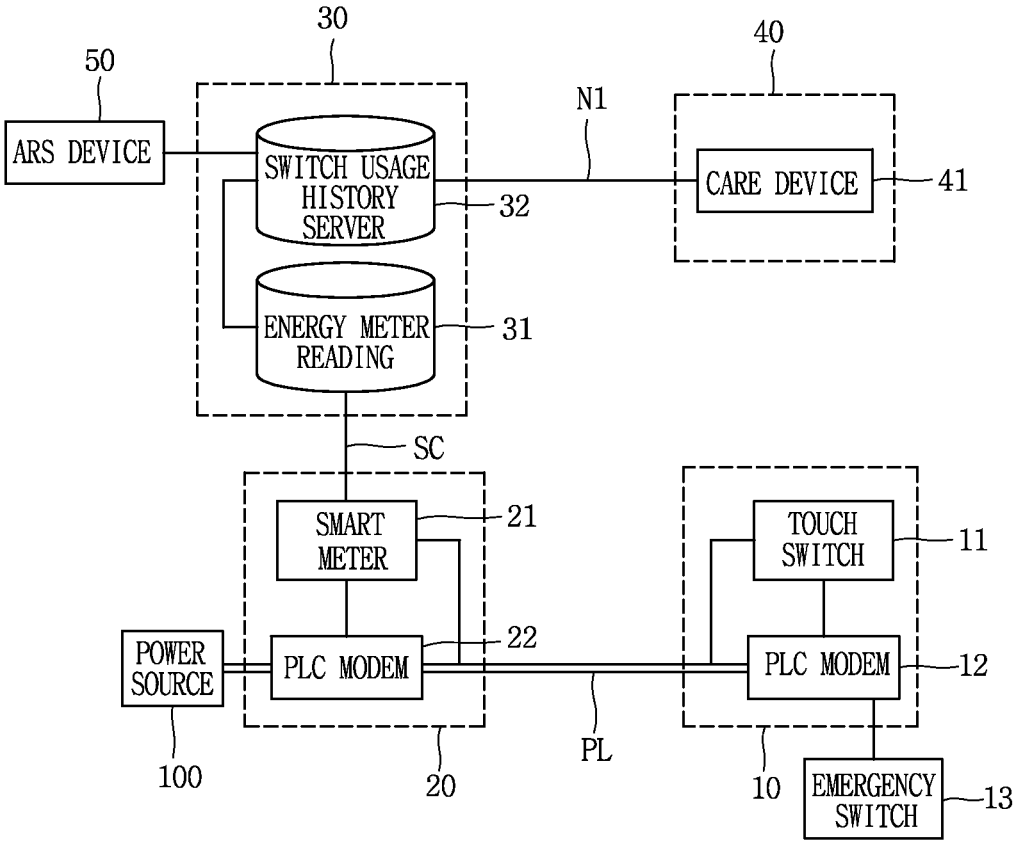
FIG. 1 is a block diagram illustrating a configuration of a solitary senior people care system according to an exemplary embodiment of the present disclosure.

A solitary senior people care system according to an exemplary embodiment of the present disclosure may be installed to be operated in apartment houses in which solitary senior people reside or welfare facilities such as silver towns, and the like. As illustrated in FIG. 1, the solitary senior people care system may include an electric device switch 11, a household monitoring communication device 21, an electric device switch history server computer 32, and a care device 41.

The electric device switch 11 is a switch of an electric device installed in a household where a solitary senior person resides, for example, an electric switch for turning on or off an electric light. Preferably, the electric device switch 11 may be configured as a capacitive sensing type touch switch or an ordinary contact type electric switch. In the case in which the electric device switch 11 is configured as a capacitive sensing type touch switch, the electric device switch 11 may operate in response to minute static electricity flowing in a human body, eliminating a possibility of an erroneous operation due to a contact other than a physical contact, and thus, it may effectively monitor whether a senior resident does normal activities.

As can be seen in FIG. 1, the electric device switch 11 may be electrically connected to a first power line communication (abbreviated as PLC hereinafter) modem 12 for power line communication through a power line (abbreviated as PL hereinafter) of apartment houses including a household where a senior resident resides, and the electric device switch 11 may constitute a switch communication device 10 together with the first PLC modem 12.

According to the exemplary embodiment of the present disclosure, an emergency rescue request switch 13 may be electrically connected to the first PLC modem 12.

The emergency rescue request switch 13 may be installed in a household where a senior resident resides and connected to the household monitoring communication device 21 through the first PLC modem 12 and a second PLC modem 22 to transmit an emergency rescue request signal to the electric device switch history server computer 32. The emergency rescue request switch 13 may be configured as, for example, a switch installed on a wall surface of a rest room of a household where a senior resident resides, and preferably, the emergency rescue request switch 13 may be configured as a capacitive sensing type touch switch.

The household monitoring communication device 21 is installed in the household, and connected to the electric device switch 11 through the PL, namely, through the PL of a house, and monitors on or off state information of the electric device switch 11.

In order for the household monitoring communication device 21 to be connected for communication with the electric device switch 11 through an indoor PL, the household monitoring communication device 21 may be connected to the indoor power line PL through the second PLC modem 22.

The household monitoring communication device 21 and the second PLC modem 22 may constitute a household monitoring communication section 20 together.

The household monitoring communication device 21 may be configured as a smart meter or a home control unit, and may provide on or off state information of the electric device switch 11 and previously stored identity information of the electric switch 11 together. Also, the household monitoring communication device 21 may have a leave button (not shown) so that the senior resident may press it when he goes out. When the senior resident presses the leave button, the household monitoring communication device 21 may transmit an absent state as a signal to the electric device switch history server computer 32.

Also, the household monitoring communication device 21 may have a communication unit for data communication with the electric device switch history server computer 32, and according to an exemplary embodiment of the present disclosure, the communication unit may be configured as a serial communication modem for serial communication through a serial communication dedicated line (abbreviated as SC hereinafter) such as RS-485.

In FIG. 1, reference numeral 100 designates a commercial alternating current electric power source.

The electric device switch history server computer 32 may be connected to the household monitoring communication device 21 through a communication network. Here, the communication network may be a serial communication network according to an exemplary embodiment of the present disclosure. As described above, the communication network may be configured as the serial communication dedicated line SC, and may be replaced with various communication networks such as wireless communication, the Internet, mobile communication, and the like, so as to be configured according to another exemplary embodiment of the present disclosure.

The electric device switch history server computer 32 may store electric device switch state information, a senior resident household electric device switch usage history information, and an electric device switch setting information, and provide the same.

Here, the electric device switch state information includes electric device switch on or off state information of a senior resident household transmitted by the household monitoring communication device 21 and identity information of the electric device switch 11 (namely, identification data of the corresponding electric device switch).

Also, the electric device switch state information may further include at least one of identity information of a solitary senior resident household (for example, information indicating a name, an address, and a phone number of a solitary senior resident), information regarding an elapse time after a final on or off operation of the electric device switch 11, state value information indicating whether an emergency situation occurs, absence mode state value information indicating whether a solitary senior resident of a corresponding household is absent, information regarding a contact number of a guardian when an emergency situation occurs, and information regarding an emergency rescue center contact number when an emergency situation occurs.

Here, the state value information indicating whether an emergency situation occurs is information regarding whether an emergency situation occurs, determined by the electric device switch history server computer 32 on the basis of the information regarding an elapse time after a final on or off operation of the electric device switch 11 and electric device switch setting information including reference time information and daytime or nighttime state discrimination setting information.

Figure 2:
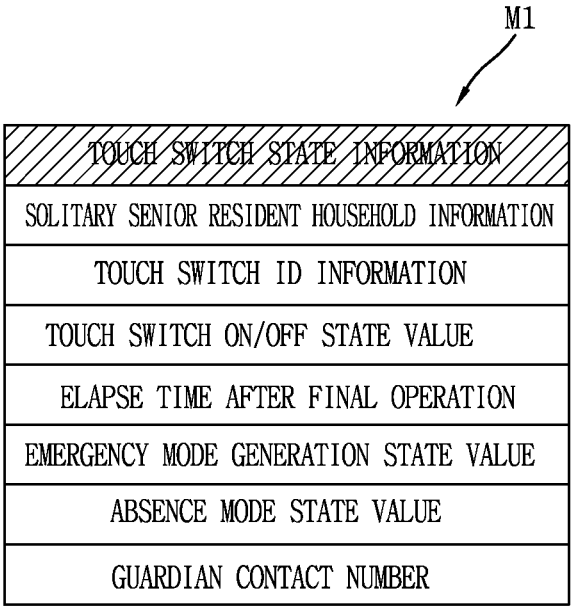
FIG. 2 is a data information configuration table illustrating an example of electric device switch state information contents in storage data information contents of an electric device switch history server computer of the solitary senior people care system according to an exemplary embodiment of the present disclosure.

As illustrated in FIG. 2, the electric device switch state information may be stored in a memory M1 included in the electric device switch history server computer 32 devised to store electric device switch state information.

The solitary senior resident household electric device switch usage history information includes date and time information on which the electronic device switch 11 was finally in an on state, date and time information on which the electric device switch 11 was finally in an off state, and information regarding a date and time on which an emergency situation occurred.

The solitary senior resident household electric device switch usage history information may further include at least one of information regarding an average operation duration from a point in time at which the electric device switch 11 is turned on to a point in time at which the electric device switch 11 is turned off, date and time information on which an emergency situation occurred with a solitary senior resident, and absence state (absence mode) setting date and time information.

Here, the information regarding an average operation duration from a point in time at which the electric device switch 11 is turned on to a point in time at which the electric device switch 11 is turned off is, in particular, information that may be used as a reference for setting the reference time information to determine whether the emergency situation has been occurred or not.

The date and time information on which an emergency situation occurred with a solitary senior resident may be provided together when the care device 41 as described hereinafter notifies a guardian or an emergency rescue center about the emergency situation, so that a rescue may be promptly made.

The absence state setting date information may provide information regarding a date and time on which an absence state of a senior resident was set. Thus, for example, in a case in which a manager of a control office recognizes that an absence state of a senior resident exceeds 24 hours, the manager may try to contact or visit the corresponding household to check a change in or continuation of the absence state, or may ascertain reliability of the setting information of the absence mode based on an elapsed time from the date and time on which the absence state was set and/or electric device switch on or off state information of the solitary senior resident household. In this manner, the absence state setting date information may be effectively used.

Figure 3:
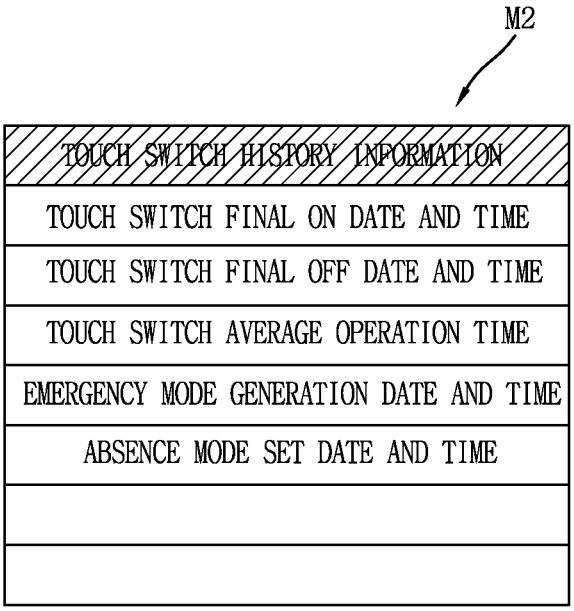
FIG. 3 is a data information configuration table illustrating an example of electric device switch usage history information contents in storage data information contents of an electric device switch history server computer of the solitary senior people care system according to an exemplary embodiment of the present disclosure.

The electric device switch usage history information may be stored in a memory M2 included in the electric device switch history server computer 32 which serves to store electric device switch usage history information as illustrated in FIG. 3.

The electric device switch setting information includes electric device switch on or off elapse reference time information for determining whether an emergency situation occurs, information regarding setting and cancelling discrimination of a daytime state or a nighttime state, and information regarding setting and cancelling occurrence of an emergency situation (or an emergency mode) and setting or cancelling an absence mode.

Here, the information regarding setting or cancelling occurrence of an emergency situation (emergency mode) is information set when the state value information indicating whether an emergency situation occurs indicates that occurrence of an emergency situation, and manually cancelled after the manager of the control office checks it (makes contact with the corresponding household or directly visits the corresponding household) or automatically released based on information automatically checked and provided by an ARS device as described hereinafter.

The information of setting and cancelling an absence mode may be automatically set/cancelled or manually set/cancelled.

Figure 4:
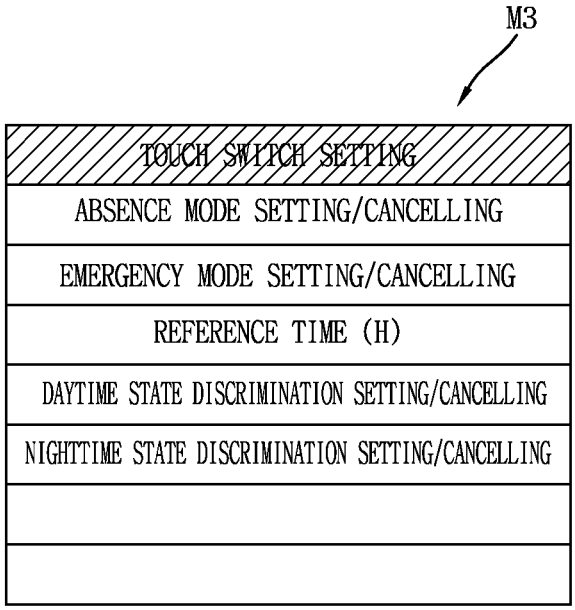
FIG. 4 is a data information configuration table illustrating an example of electric device switch setting information contents in storage data information contents of an electric device switch history server computer of the solitary senior people care system according to an exemplary embodiment of the present disclosure.

Here, the automatic setting may be performed such that when a solitary senior resident presses a leave button provided in a smart meter or a home control unit constituting the household monitoring communication device 21, a signal is transmitted to the electric device switch history server computer 32, and upon receiving the signal, the electric device switch history server computer 32 sets it in a memory M3 included therein as illustrated in FIG. 4.

Automatic cancelling may be performed such that when the solitary senior resident, who has got home, presses the leave button, for example, for a long period of time, to send a signal indicating that he is home to the electric device switch history server computer 32, and upon receiving the corresponding signal, the electric device switch history server computer 32 corrects setting information as a cancelled state in the memory M3 included therein.

In case of manual setting, the manager of the control office or staff of a solitary senior people care system operating company checks a recorded screen of a closed circuit device installed in an elevator or a predetermined location of the apartment houses at predetermined time intervals every day to check whether a solitary senior resident goes out and set an absence mode by using an interface unit such as a monitor, a keyboard, a mouse, or the like, accessible to the electric device switch history server computer 32, or may manually cancel the absence mode by checking whether solitary senior resident has got home by checking a recorded screen.

The electric device switch setting information may be stored in the memory M3 included in the electric device switch history server computer 32 which serves to store electric device switch setting information as illustrated in FIG. 4.

The care device 41 is connected to the electric device switch history server computer 32 through a communication network N1, and includes a computing and storage unit such as a microcomputer, and a communication unit. When an emergency situation occurs, the care device 41 notifies an emergency rescue center or a contact number of a guardian about the occurrence of the emergency situation according to solitary senior resident household electric device switch usage history information and state value information indicating whether an emergency situation occurs from the electric device switch history server computer 32.

Here, the communication network N1 may be any one of a wired medium such as a serial communication line and an ordinary wired telephone line, a wireless communication medium, and a mobile communication medium.

When an emergency situation occurs, the computing and storage unit of the care device 41 may provide a previously stored rescue request message such as "Emergency occurs with Mr. so-and-so of #00, building 00, apartment 00, please move swiftly to the rescue" as a notification message, a senior resident and household identity message, and a message regarding a date and time on which a senior resident emergency situation occurs according to a solitary senior resident household electric device switch usage history information such as "date of occurrence: 00 min, 00 hour p.m., 00 date, 00 month, 00 year" to an emergency rescue center or a guardian contact number through any one of an ordinary wired telephone line, a wireless communication medium, a mobile communication medium through the communication unit.

As can be seen from FIG. 1, the solitary senior people care system according to the exemplary embodiment of the present disclosure may further include an ARS device 50. The ARS device 50 may be connected to the electric device switch history server computer 32 through a signal line, and include a computing and storage unit such as a microcomputer and a communication unit such as a telephone modem.

When the electric device switch history server computer 32 determines that an emergency situation has occurred, the ARS device 50 may automatically make a call to a previously stored telephone number (a phone number provided by the electric device switch history server computer 32). When a corresponding senior resident receives the call, the ARS device 50 transmits a previously stored voice announcement message. When the senior resident returns the call to indicate that there is no problem with his physical condition by pressing a telephone button according to guidance of the corresponding voice announcement message, the ARS device 50 may provide information for cancelling the emergency situation mode to the electric device switch history server computer 32.

When the corresponding senior resident, who has received the call, presses a button of the telephone indicating an emergency situation in which his or her physical condition has a problem according to guidance of the corresponding voice announcement message or when the corresponding senior resident does not answer the phone, the ARS device 50 may inform the electric device switch history server computer 32 accordingly to thus automatically check (in other words finally confirm) the state value information indicating whether an emergency situation occurs.

Hereinafter, an operation of the solitary senior people care system according to the exemplary embodiment of the present disclosure will be described with reference to FIGS. 5 and 6 mainly and with reference to FIGS. 1 through 4 adjunctively.

First, an operation of the solitary senior people care system according to the exemplary embodiment of the present disclosure will be described with reference to FIG. 5.

First, in the solitary senior people care system according to the exemplary embodiment of the present disclosure, a central processing unit (abbreviated as CPU hereinafter) included in the electric device switch history server computer 32 checks information for setting or cancelling an absence mode set and stored in the memory M3 included in the electric device switch history server computer 32 according to a previously stored program (ST1).

When the absence mode is set in step ST1, the CPU repeatedly performs an operation of checking the information of setting or cancelling the absence mode, and when the absence mode is cancelled, the CPU included in the electric device switch history server computer 32 may check a change in an on or off state of the electric device switch 11 in step ST2.

When an on or off state of the electric device switch 11 has been changed in step ST2, the CPU included in the electric device switch history server computer 32 considers that the solitary senior resident in a household is active without abnormality and repeatedly performs the operation of checking a change in the on or off state, and when there is no change in the on or off state, the CPU counts an elapse time in step ST3.

Thereafter, the counted elapse time is compared with a value of electric device switch on or off elapse reference time information set and stored in the memory M3 of the electric device switch history server computer 32. When the elapse time exceeds the value of the electric device switch on or off elapse reference time information according to the comparison results, the CPU determines that an emergency situation (emergency mode) has occurred (step ST5), while when the elapse time does not reach the value of the electric device switch on or off elapse reference time information according to the comparison results, the CPU repeatedly performs the operation of step ST4.

Thereafter, the CPU included in the electric device switch history server computer 32 sets an emergency mode, namely, sets an emergency mode state value of the memory M1 included in the electric device switch history server computer 32 to an emergency state, and records an emergency mode setting value of the memory M3 as SET in step ST6.

Meanwhile, although not shown, even when the solitary senior resident directly operates the emergency rescue request switch 13 to request for rescue, the CPU included in the electric device switch history server computer 32 sets an emergency mode, namely, sets the emergency mode state value of the memory M1 included in the electric device switch history server computer 32 to an emergency state, and records the emergency mode setting value of the memory M3 as SET.

In this manner, a monitoring operation as to whether an emergency situation has occurred with respect to a solitary senior resident performed in the solitary senior people care system according to the exemplary embodiment of the present disclosure may be terminated.

Hereinafter, an operation of taking measures by the solitary senior people care system according to the exemplary embodiment of the present disclosure when an emergency situation occurs will be described.

Figure 5:
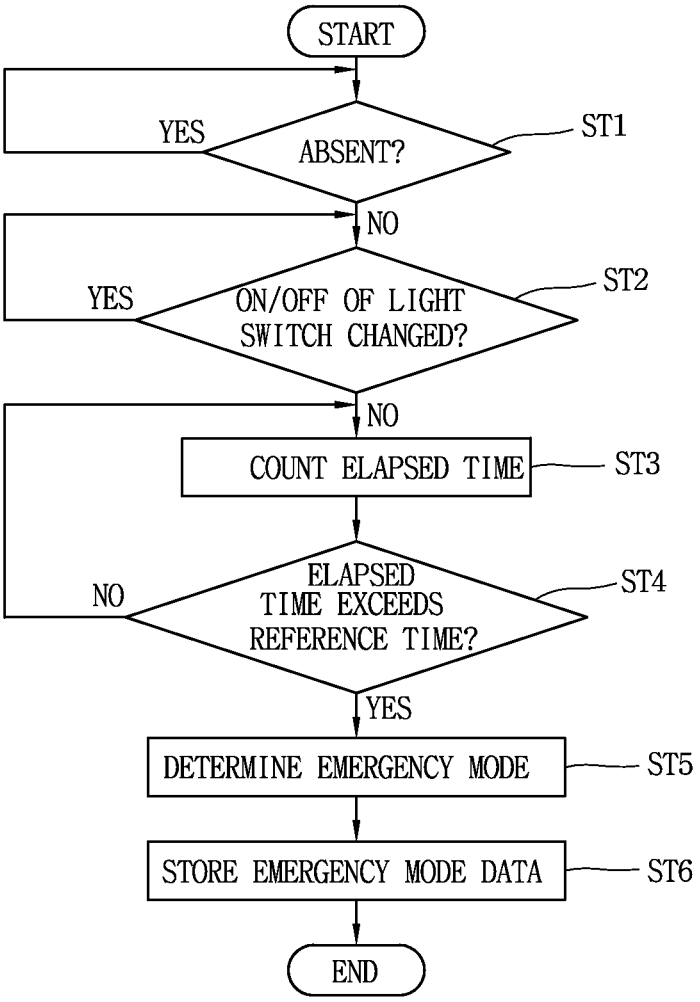
FIG. 5 is a flow chart illustrating a process of determining an emergency mode performed in an electric device switch history server computer of the solitary senior people care system according to an exemplary embodiment of the present disclosure.
Figure 6:
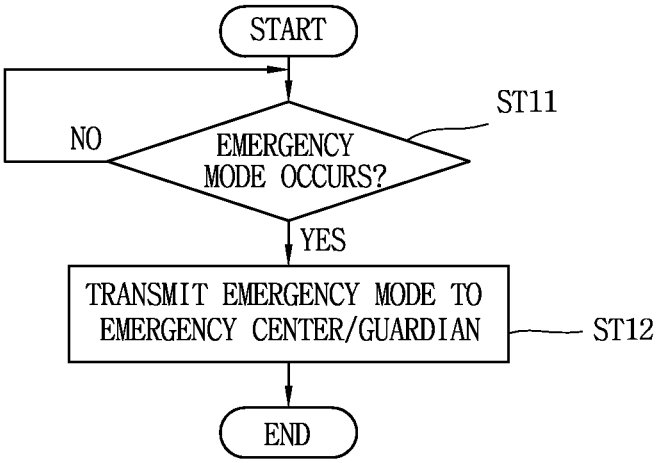
FIG. 6 is a flow chart illustrating a process of notifying about emergency situation occurrence by a care device of the solitary senior people care system according to an exemplary embodiment of the present disclosure.

Occurrence of an emergency situation may be classified into a case in which a solitary senior resident directly operates the emergency rescue request switch 13 to request for emergency rescue and a case in which the solitary senior people care system according to the present exemplary embodiment automatically determines the emergency situation as illustrated in FIG. 5. In both cases, the emergency mode state value of the memory M1 included in the electric device switch history server computer 32 is set to an emergency state and the emergency mode setting value of the memory M3 is also stored as SET.

In step ST11, a CPU of the microprocessor included in the care device 41 reads the emergency mode state value of the memory M1 of the electric device switch history server computer 32 or the emergency mode setting value of the memory M3 and determines whether an emergency mode has occurred.

In a case in which an emergency mode has not occurred in step ST11, the CPU of the microprocessor included in the care device 41 repeatedly performs the operation of step ST11.

In the case in which the CPU determines an emergency mode has occurred in step ST11, the CPU of the microprocessor included in the care device 41 may transmit the previously stored rescue request message, a senior resident and household identity message, and a message indicating a date and time on which an emergency situation occurred with respect to a senior resident according to the solitary senior resident household electric device switch usage history information to a contact number of a guardian or an emergency rescue center through any one of a wired medium such as a wired telephone line, a wireless communication medium, and a mobile communication medium through the communication unit based on identity information of the solitary senior resident and the information regarding a date and time on which the emergency situation has occurred provided by the electric device switch history server computer 32 connected to the care device 41 in step ST12.

Then, the guardian or a member(s) of the emergency rescue center may visit the senior resident household to rescue the senior resident from the emergency situation.

As described above, in the solitary senior people care system according to the exemplary embodiment of the present disclosure, although a solitary senior resident cannot provide information by himself, if there is no change in a state of the electric device switch for more than a predetermined period of time based on ON (in other words lighting)/OFF (in other words putting out light) state information of the electric device switch of the household where a solitary senior resident resides and electric device switch setting information, occurrence of an emergency situation may be automatically determined and the emergency rescue center or a guardian contact number may be immediately informed about the generated emergency situation to rescue the solitary senior resident.

In the solitary senior people care system according to the exemplary embodiment of the present disclosure, since the electric device switch is configured as a capacitive sensing type touch switch, the electric device switch may be turned on or off through an actual human body contact while a solitary senior resident lives in the household, thereby effectively recognizing whether the solitary senior resident lives a normal life.

Since the solitary senior people care system according to the exemplary embodiment of the present disclosure further includes the emergency rescue request switch installed in a household where a solitary senior resident resides and connected to a household monitoring communication device to transmit an emergency rescue request signal to the electric device switch history server computer through the household monitoring communication device, when a solitary senior resident of a household operates the corresponding emergency rescue request switch, the electric device switch history server computer may receive corresponding state information and immediately provide the same to the emergency rescue center or the guardian contact number through the care device, whereby measures may be taken immediately.

In the solitary senior people care system according to the exemplary embodiment of the present disclosure, since the electric device switch state information includes identity information of a solitary senior resident household, when an emergency situation occurs, information regarding the occurrence of the emergency may be accurately provided to an emergency center. The ARS device may make a call to the solitary senior resident to check or cancel the generated emergency situation (emergency mode). Also, since elapse time information is included after a final on or off operation of the electric device switch, an elapse time may be compared with a reference time of determining occurrence of an emergency situation to promptly determine whether an emergency situation has occurred. Also, since absence mode state value information indicating whether a solitary senior resident of a corresponding household is absent is included, erroneously determining occurrence of an emergency situation when a solitary senior resident is absent is prevented. Also, since guardian contact number information is included when an emergency situation occurs, information regarding the occurrence of the abnormality (emergency situation) may be rapidly provided to a guardian.

In the solitary senior people care system according to the exemplary embodiment of the present disclosure, since the electric device switch state information further includes at least one of identity information of a solitary senior resident household, information regarding a time elapsed after the electric device switch was finally turned on or off, state value information indicating whether an emergency situation occurs, absence mode state value information indicating whether a solitary senior resident of a corresponding household is absent, and information regarding a contact number of a guardian in the event of an emergency situation, identity information of the solitary senior resident household encountering an emergency situation may be rapidly delivered, an elapse time after a final on or off operation of the electric device switch may be compared with a reference time, whether an emergency situation has currently occurred is quickly determined, whether a solitary senior resident of a corresponding household is currently absent may be quickly determined, or when abnormality occurs, a contact number of a guardian may be quickly recognized.

In the solitary senior people care system according to the exemplary embodiment of the present disclosure, since the solitary senior resident household electric device switch usage history information further includes at least one of information regarding an average operation time until when the electric device switch is turned off from an on state, information regarding a date and time on which abnormality occurs with a solitary senior resident, and absence state setting date and time information, occurrence of an abnormal situation may be quickly determined based on the average operation time from on to off of the electric device switch, a date and time on which an abnormal state of a solitary senior resident has occurred may be quickly provided to a guardian or an emergency rescue center to take measures promptly, or an abnormal leave for a long period of time may be determined by recognizing an elapse time from an absence state of a solitary senior resident.

In the solitary senior people care system according to the exemplary embodiment of the present disclosure, since the household monitoring communication device is configured as a smart meter or a home control unit, it may collect electric device switch on or off history information of a solitary senior resident household and transmit it as data to the electric device switch history server computer.

In another aspect, since the solitary senior people care system according to the exemplary embodiment of the present disclosure further include the ARS device, when the electric device switch history server computer determines that an emergency situation has occurred, the ARS device automatically makes a call to a previously stored phone number to provide information for checking state value information indicating whether the emergency situation has occurred or information for cancelling the emergency situation mode to the electric device switch history server computer.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A solitary senior people care system comprising:

an electric device switch installed within a household where a solitary senior resident resides;

a household monitoring communication device having a communication unit, connected to the electric device switch through a power line, configured to monitor on or off state information of the electric device switch, and configured to provide the on or off state information and identity information of the electric device switch together;

an electric device switch history server computer connected to the household monitoring communication device through a communication network, and that stores and provides a solitary senior resident household electric device switch usage history information including information regarding a date and time at which the electric device switch was finally in an on state and information regarding a date and time at which the electric device switch was finally in an off state, electric device switch setting information including reference information for determining occurrence of an emergency situation, and electric device switching state information including at least any one of electric device switch on or off state information of a solitary senior resident house, identity information of the electric device switch, identity information of the solitary senior resident household, and state value information indicating whether an emergency situation has occurred determined based on information regarding a time lapsed after an final operation of the electric device switch and the electric device switch setting information; and a care device connected to the electric device switch history server computer, and configured to notify an emergency rescue center or a guardian contact number about occurrence of an emergency situation when an emergency situation occurs according to at least any one of the electric device switch state information, the solitary senior resident household electric device switch usage history information, and the state value information indicating whether an emergency situation has occurred, from the electric device switch history server computer.

2. The solitary senior people care system of claim 1, wherein the electric device switch is configured as a capacitive sensing type touch switch or an ordinary contact type electric light switch.

3. The solitary senior people care system of claim 1, further comprising:

an emergency rescue request switch installed in a household where a solitary senior resident resides, and connected to the household monitoring communication device to transmit an emergency rescue request signal to the electric device switch history server computer through the household monitoring communication device.

4. The solitary senior people care system of claim 1, wherein the reference information comprises any one of the electric device switch on or off elapse reference time information, daytime or nighttime state discrimination setting and cancelling information, and emergency situation occurrence setting or cancelling information.

5. The solitary senior people care system of claim 1, wherein the electric device switch state information further comprises at least one of information regarding an elapse time after a final on or off operation of the electric device switch, an absence mode state value indicating whether a senior resident of a corresponding household is absent, information regarding guardian contact number in the occurrence of an emergency situation, and emergency rescue center contact number information in the occurrence of an emergency situation.

6. The solitary senior people care system of claim 1, wherein the solitary senior resident household electric device switch usage history information further comprises at least one of information regarding an average operation time from a point in time at which the electric device switch is turned to a point in time at which the electric device is tuned off, solitary senior resident emergency situation occurrence date and time information, and absence mode setting date and time information.

7. The solitary senior people care system of claim 1, wherein the household monitoring communication device is configured as a smart meter or a home control unit.

8. The solitary senior people care system of claim 1, further comprising:

an automatic response system (ARS) connected to the electric device switch history server computer, and configured to, when the electric device switch history server computer determines that an emergency situation has occurred, automatically making a call to a previously stored phone number to check state value information indicating whether the emergency situation has occurred or provide information for cancelling the setting of emergency situation occurrence to the electric device switch history server computer.

9. A solitary senior people care system comprising:

an electric device switch installed within a household;

a household monitoring communication device having a communication unit that is connected to the electric device switch via a power line and is configured to monitor state information of the electric device switch and to provide the state information with identity information of the electric device switch;

a server computer that is connected to the household monitoring communication device via a communication network and configured to:

store usage history information of the electric device switch, setting information of the electric device switch, and state information of the electric device switch; and determine emergency information indicating whether an emergency situation has occurred based on information related to an elapsed time since a last operation of the electric device switch and the setting information; and a care device connected to the server computer and configured to notify an emergency rescue center or a guardian about occurrence of the emergency situation according to at least the state information, the usage history information or the emergency information, wherein the usage history information includes information related to a date and time at which the electric device switch was last in an on state and information related to a date and time at which the electric device switch was last in an off state, wherein the setting information includes reference information for determining the emergency information, and wherein the state information includes at least on or off state information of the electric device switch, the identity information of the electric device switch or identity information of the household.

10. The system of claim 9, wherein the electric device switch is configured as a capacitive sensing type touch switch or a contact type electric light switch.

11. The system of claim 9, further comprising:

an emergency rescue request switch that is installed in the household, connected to the household monitoring communication device and configured to transmit an emergency rescue request signal to the server computer via the household monitoring communication device.

12. The system of claim 9, wherein the reference information includes on or off elapse reference time information of the electric device switch, daytime or nighttime state discrimination setting and cancelling information or emergency situation occurrence setting or cancelling information.

13. The system of claim 9, wherein the state information of the electric device switch further includes at least information related to an elapsed time after a final on or off operation of the electric device switch, a value indicating whether a solitary senior resident is absent from the household, a contact number of the guardian or a contact number of the emergency rescue center.

14. The system of claim 9, wherein the usage history information of the electric device switch further includes at least information related to an average operation time from a time at which the electric device switch is turned on to a time at which the electric device is tuned off, date and time information of the occurrence of the emergency situation or absence mode setting date and time information.

15. The system of claim 9, wherein the household monitoring communication device is a smart meter or a home control unit.

16. The system of claim 9, further comprising:

an automatic response system (ARS) connected to the server computer and configured to at least automatically call a previously stored phone number in order to check state value information indicating whether the emergency situation has occurred or provide information for canceling the setting of an emergency situation occurrence to the server computer when the server computer determines that that the emergency situation has occurred.

* * * * *